US007828145B2

(12) United States Patent
Grandér

(10) Patent No.: US 7,828,145 B2
(45) Date of Patent: Nov. 9, 2010

(54) GOLF BAG

(75) Inventor: Jonas Grandér, London (GB)

(73) Assignee: White Angel AB, Djursholm (SE)

( * ) Notice: Subject to any disclaimer, the term of this patent is extended or adjusted under 35 U.S.C. 154(b) by 132 days.

(21) Appl. No.: 11/964,358

(22) Filed: Dec. 26, 2007

(65) Prior Publication Data

US 2009/0145787 A1 Jun. 11, 2009

(30) Foreign Application Priority Data

Dec. 6, 2007 (SE) ..... 0702716

(51) Int. Cl.
*A63B 55/00* (2006.01)

(52) U.S. Cl. ..... 206/315.3; 206/315.2; 206/315.1; 224/259; 224/250

(58) Field of Classification Search ..... 206/315.3, 206/351.2, 315.1; 224/259, 250
See application file for complete search history.

(56) References Cited

U.S. PATENT DOCUMENTS

| | | | | |
|---|---|---|---|---|
| 1,570,500 | A | 1/1926 | Kennedy | |
| 2,547,829 | A * | 4/1951 | Mills | 206/315.2 |
| 2,911,228 | A * | 11/1959 | Green | 280/655 |
| 3,581,961 | A * | 6/1971 | Owens | 224/262 |
| 3,889,859 | A * | 6/1975 | Joseph | 224/634 |
| 4,286,739 | A * | 9/1981 | Silcott et al. | 224/156 |
| 5,154,377 | A * | 10/1992 | Suk | 248/96 |
| 5,397,084 | A * | 3/1995 | Wang | 248/96 |
| 5,415,284 | A * | 5/1995 | King | 206/315.6 |
| 5,419,473 | A * | 5/1995 | Lamar | 224/632 |
| 5,582,290 | A * | 12/1996 | McCuaig et al. | 206/315.6 |
| 5,609,279 | A * | 3/1997 | O'Shea | 224/160 |
| 5,868,247 | A * | 2/1999 | Schrader | 206/315.4 |
| 5,950,886 | A * | 9/1999 | Maupin | 224/157 |
| 6,216,865 | B1 * | 4/2001 | Maeng | 206/315.6 |
| 6,352,154 | B1 * | 3/2002 | Miura | 206/315.6 |
| 6,536,641 | B1 * | 3/2003 | Sundara et al. | 224/637 |
| 6,840,419 | B2 * | 1/2005 | Penny et al. | 224/637 |
| 7,124,888 | B1 * | 10/2006 | Valdez et al. | 206/315.4 |
| 7,232,049 | B2 * | 6/2007 | Meyer | 224/637 |
| 2004/0074791 | A1 * | 4/2004 | Lewter | 206/315.3 |
| 2005/0082184 | A1 * | 4/2005 | Lewter | 206/315.3 |
| 2006/0081671 | A1 * | 4/2006 | Grant | 224/576 |

FOREIGN PATENT DOCUMENTS

| | | |
|---|---|---|
| GB | 203222 | 9/1923 |

* cited by examiner

*Primary Examiner*—Anthony Stashick
*Assistant Examiner*—Cynthia F Collado
(74) *Attorney, Agent, or Firm*—Young & Thompson

(57) ABSTRACT

A bag for the storage and transport of golf equipment includes at least two sections, each including an upper and a lower edge, respectively, where the sections are pivotably interconnected in a hinge, where the bag is openable by folding the sections apart along the hinge, towards an open position in which the interior of the bag is uncovered. At least one section includes a fastening element for golf club shafts in its upper part, in that at least one section includes club head separating element in its lower part for receiving club heads of one or more golf clubs whose shafts are fastened to the fastening element, in that the hinge is arranged along the lower respective edge of each section, and in that the bag includes a support element so that the bag can stand in a stable manner on a supporting surface when in its opened position.

19 Claims, 6 Drawing Sheets

GOLF BAG

The present invention relates to a bag for storing and transporting golf clubs.

BACKGROUND OF THE INVENTION

When practicing golf sport, in many cases the practitioner has to bring a set of golf clubs, together with various types of peripheral equipment, such as balls, tees, gloves, etc. Not only is this true regarding transportation to and from the golf sport facilities, but also the stay there, as well as during the golf play itself. Furthermore, the equipment needs storage when not used.

Transport to and from the golf sport facilities can of course be carried out in many different ways, but some ways of transportation are associated with certain problems. Namely, a conventional bag of the golf bag type is quite bulky and difficult to take, for example when travelling by foot, by bike or by motorcycle, but also for example when using public transport such as on a bus. This is so for the classic golf bag, which essentially consists of an elongated tube down into which the clubs are put with their shafts first, with or without a cart, as well as for the more recently presented carry bag, which also essentially consists of an elongated tube, down into which the clubs are put shafts first, but which is carried with the bag on the back in an inclined manner.

It is also common practice for a player to bring only a few golf clubs to the facilities, such as for practice, whereby conventional golf bags do not offer a simple and comfortable transport in relation to the small amount of transported equipment.

During the game itself, demands for speed and flexibility are becoming increasingly more common, not least when playing so-called "speed golf", where players often run between strokes. Of course, such demands also arise for other golfing variants. A conventional carry bag does indeed allow the user to move relatively freely over the playing field, but still imposes a problem when, for example, searching for lost balls in dense woods or brushwood. Namely, the bag and the club shafts extend a certain distance on either side of the player's body. Also, it is difficult to move around quickly and ergonomically with such a carry bag, partly because of the tendency of the clubs to rattle around in the bag as the player moves, even in the case where the interior of the bag is divided into a number of separated partitions for different clubs, partly because of the fact that the bag needs to be positioned either so high on the player's back so as to provide bad ergonomics, or so low so as to risk hitting against the behind of the player, which lessens the mobility of the player, for example when running.

Furthermore, a conventional carry bag is often unnecessarily heavy, clumsy, and not ergonomical enough for use by, for example, smaller lady and junior players, but also by elderly players. The bad ergonomics is increased because of the club heads being asymmetrically positioned outside of the bag, thereby displacing the centre of gravity.

Hence, it would be desirable to obtain a low-weight bag for golf clubs and peripheral equipment which is simple and easy to transport, even on foot, by bike, and so on, and at the same time offering good ergonomics during transport on the golf course, and not constituting an obstacle, especially not during rapid transport and/or transport in rough terrain.

Furthermore, it would be desirable to obtain such a bag which is especially advantageous when playing with only a few clubs. Moreover, it would be desirable to obtain such a bag in which golf equipment suitably can be stored when not used.

The present invention solves the above described problems.

SUMMARY OF THE INVENTION

Thus, the invention relates to a bag for the storage and transport of golf equipment, where the bag comprises at least two sections, each comprising an upper and a lower edge, respectively, where the sections are pivotably interconnected in a hinge, where the bag is openable by folding the sections apart along with the hinge, towards an opened position in which the interior of the bag is uncovered, and is characterized in that at least one section comprises fastening means for golf club shafts in its upper part, in that at least one section comprises club head separating means in its lower part for receiving club heads of one or several golf clubs whose shafts are fastened to the fastening means, in that the hinge is arranged along the lower respective edge of each section, and in that the bag comprises support means so that the bag can stand in a stable manner on a supporting surface when in its opened position.

BRIEF DESCRIPTION OF THE DRAWINGS

Now, the invention will be described in detail, with reference to exemplifying embodiments of the invention and to the appended drawings, where.

DETAILED DESCRIPTION OF THE PREFERRED EMBODIMENTS

Figure 1A:
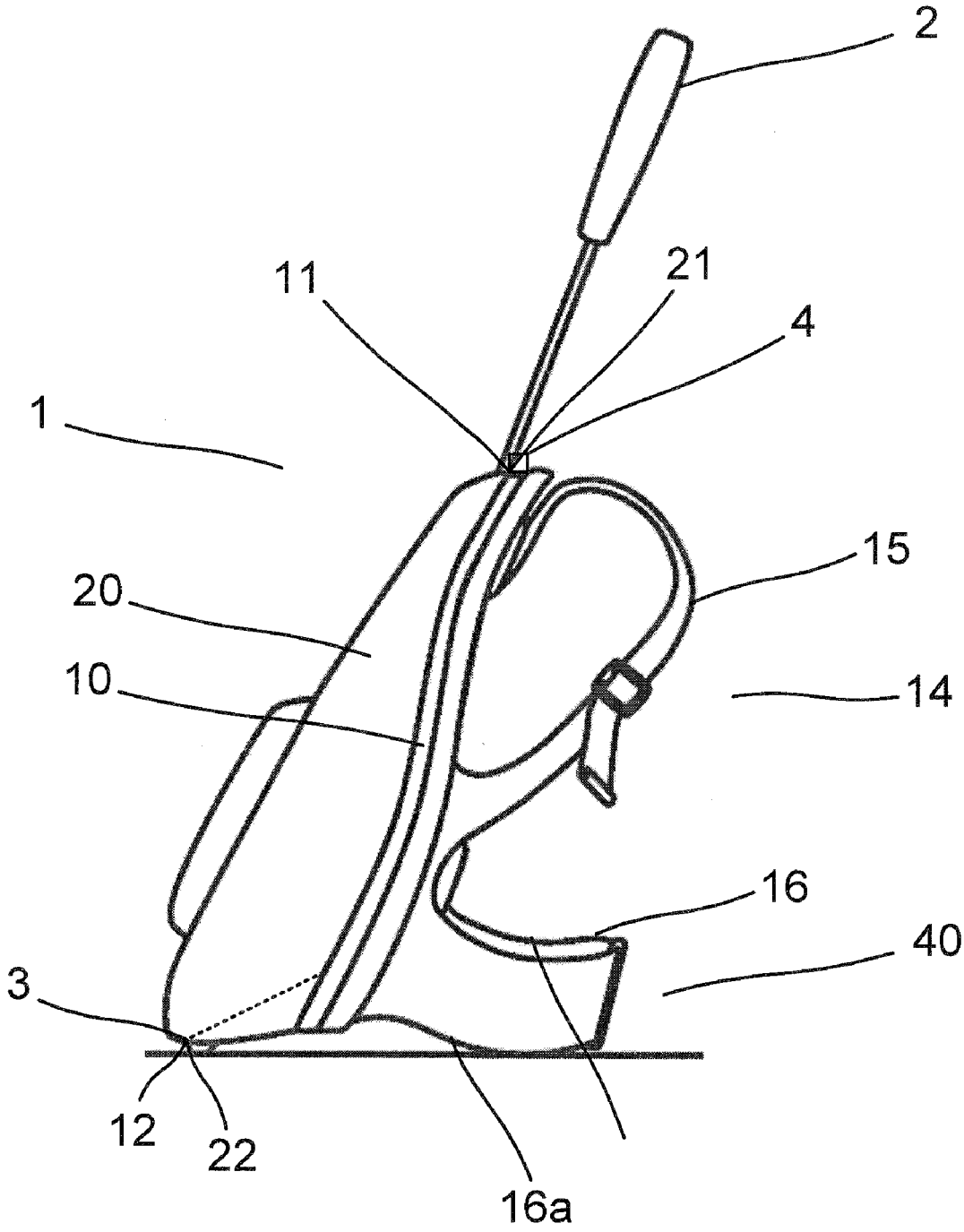
FIG. 1*a* is a perspective view of a bag according to the present invention, in its closed position.

Corresponding details in the drawings share reference numerals.

FIGS. 1*a*, 1*b*, 2*a*, and 2*b* illustrate a bag 1 for storing and transporting golf clubs 2 and peripheral equipment. The bag is illustrated in a rest position on the ground, and comprises a front 10 and a back 20 section.

The front section 10 comprises an upper edge 11 and a lower edge 12. Likewise, the back section 20 comprises an upper edge 21 and a lower edge 22. Both sections 10, 20 are pivotably interconnected using a hinge 3, arranged by the lower edge 12, 22 of each section 10, 20, respectively. Thus, the sections 10, 20 can be folded apart, about the hinge 3, towards the opened position as shown in the FIGS. 1*b* and 2*b*, and, contrarily, be folded towards each other, towards the closed position as shown in the FIGS. 1*a* and 2*a*.

The sections 10, 20 can be interconnected in other ways, known and conventional as such, by their respective lower edges 12, 22, and do not need to be interconnected using a hinge 3. What is essential is that the sections 10, 20 are interconnected by respective lower edges 12, 22, and that they are folded apart as the bag 1 is opened, so that the interior of the bag 1 is uncovered. This brings about the advantage that it is easy to open the bag 1 and to access its contents when it is positioned on the ground. Namely, this is important when playing golf, when the contents of the bag 1 usually have to be accessible from the very position where the bag 1 is standing on the ground, and since the supporting surface often consists of grass of different qualities, which renders it difficult to open a bag which, by way of example, is opened by folding a section out sideways. Moreover, heads 2*b* of the clubs 2 are made clearly visible, facilitating the choosing of a club.

At its side facing away from the back section 20, the front section 10 comprises a carrying system 14 comprising straps 15 and a hip belt 16. The carrying system 14 is arranged so that a user can carry the bag using the straps 15 and the hip belt 16 as a conventional back pack. The straps 15 as well as the hip belt 16 are preferably adjustable, so that the carrying system 14 can be adapted to suit the user.

Figure 3:
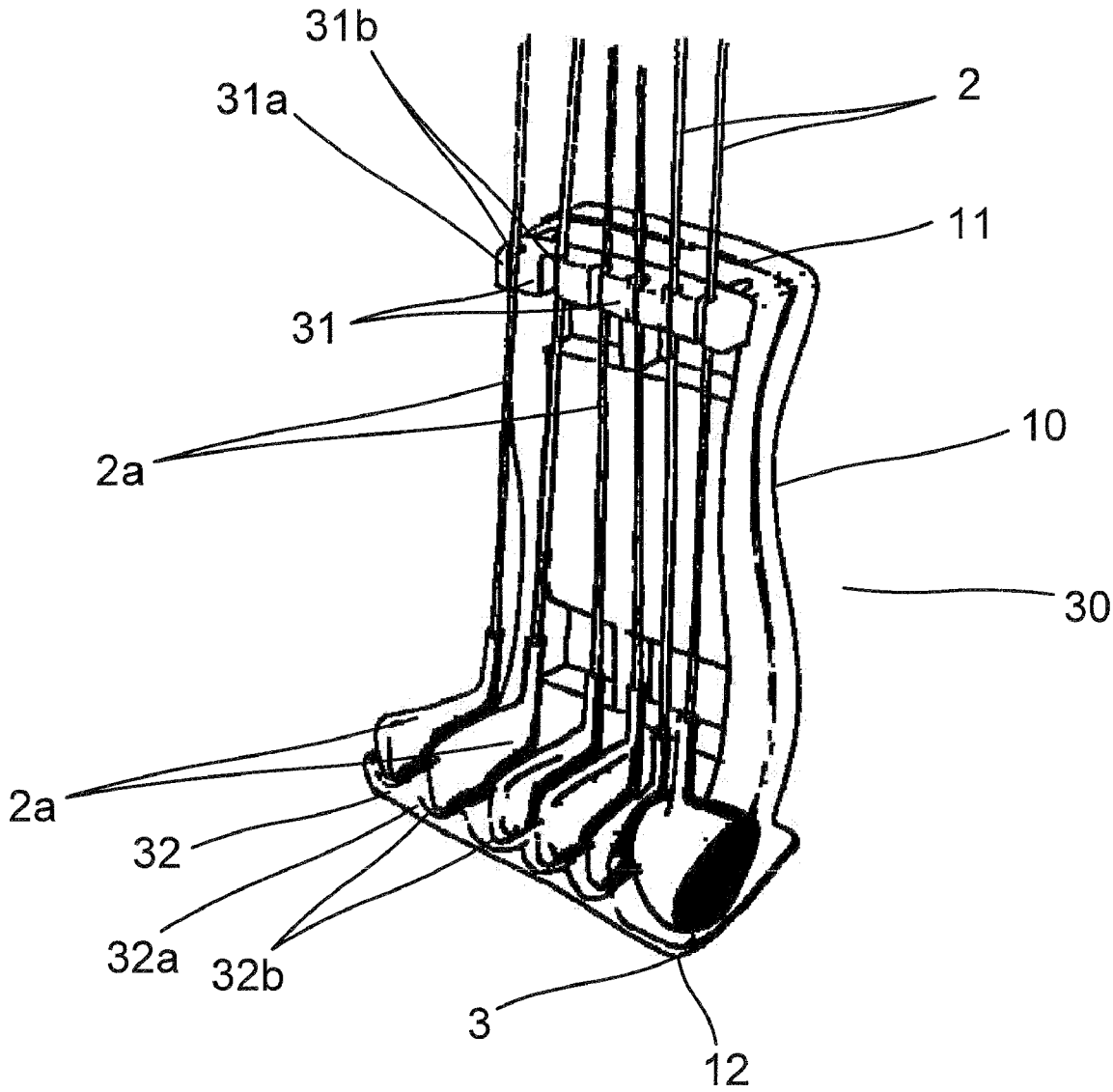
FIG. 3 is a perspective view of a section of a bag according to the invention presenting a fastening system.

Furthermore, the front section 10 comprises a fastening system 30 for golf clubs 2 being stored and/or transported in the bag 1. The fastening system 30 is best illustrated in FIG. 3, and comprises one or several fastening means 31 for the shafts 2*a* of the clubs 2, as well as one or several club head separating means 32 for accommodating the club heads 2*b* of the golf clubs.

The fastening means 31 are arranged at the side of the front section 10 facing towards the interior of the bag 1, near the upper edge 11 of the front section 10. The club head separating means 32 are arranged at the same side of the front section 10, but near the bottom of the bag 1. In other words, the bag 1 is arranged to accommodate the golf clubs 2 in a stand-up fashion with the club heads 2*b* downwards and the shafts 2*a* upwards. When the bag 1 is in its upright and closed use position, in which the bag 1 is carried on the back of the user like a conventional back pack, the clubs 2 stand essentially vertically in the bag 1. This contributes to good ergonomics and comfortable transport. This position of the bag 1 is in the following denoted "the upright position of the bag".

By the accommodation of the clubs 2 with their club heads 2*b* downwards, contained inside the bag 1, the advantage is achieved that they are already turned right side up when the user is to use them. The club heads 2*b* are protected from wear, at the same time as there no longer is a need for so called head covers, since the golf clubs 2*b* easily can be kept apart inside the bag 1.

According to the invention, the fastening means 31 are designed as an elongated body 31*a* of a flexible material such as foam plastic, rubber or the like, which comprises grooves 31*b*, dimensioned so as to make possible the pushing down into one of the grooves of a club shaft and thereby retaining the shaft, at the same time as the club shaft can be removed from the groove using a light jerk. However, it is understood that the fastening means also may be designed in other ways. By way of example, one or several VELCROϕ fasteners can be arranged to fix the club shafts 2*a*. Another example is that the fastening means 31 along one section are designed as recesses at the upper edge of the section, but not capable of retaining the shafts 2*a* per se, and that a neighbouring section at its upper edge comprises push means, arranged to apply a pressure onto the shafts 2*a*, and thereby fix them when the bag 1 is in its closed position.

According to a preferred embodiment, the club head separating means 32 are designed as individual bag containers of textile material, where each bag container is arranged to be able to accommodate one club head. According to another preferred embodiment, the club head separating means 32 are designed as an elongated body 32*a* in a flexible material such as foam plastic, rubber or the like, which comprises recesses 32*b* with such dimensions so that a club head can be accommodated in each recess 32*b*, and thereby essentially be separated from neighbouring club heads when the shafts 2*a* of the clubs 2 are also fastened to the fastening means 31.

According to an especially preferred embodiment, the club head separating means 32 are so flexibly and tight-fittingly designed so that each club head essentially can be retained in a respective club head separating means once introduced into the means.

It is mentioned above that all of the fastening means 31 and the club head separating means 32 are arranged at the front section 10. However, the fastening means 31 and the club head separating means 32 can also be arranged at the back section 20, or at different sections.

According to a preferred embodiment, one section is arranged facing another section on its opposite side, at which other section club head separating means 32 are arranged, arranged to bear on and push against the club head separating means 32 when the bag is in its closed position, and thereby contributing to the fixing of the club heads 2*b*.

Thus, the fastening system 30 is arranged to fasten each golf club individually in its shaft. Since the head of the club rests in the club head separating means 32, the club cannot be rotated around the fastening point in the fastening means 31, except possibly about the longitudinal axis of the club shaft 2*a*. Thereby, each golf club is essentially individually fixed in the bag 1. Therefore, when being stored or transported, the clubs 2 cannot rattle around in the bag 1, and the club head separating means 32 also guarantee that the club heads 2*b* do not wear or strike against each other. Moreover, orderliness and easy access of all clubs 2 is ensured.

According to a preferred embodiment, the fastening means 31 and the club head separating means 32 are designed to accommodate up to about half a golf set, in other words up to about seven clubs 2, along a row, one means next to the other. Such an arrangement is suitable for bags 1 adapted for usage for example when practicing golf or when "speed golfing".

However, a bag according to the invention can also be designed for accommodation of more than about seven clubs, for example a whole set of about fourteen clubs. By way of example, this can be accomplished by arranging the fastening means close one to another, so that the fastened club shafts are separated by the fastening means but otherwise are located very near each other, at the same time as the club head separating means are arranged in double rows, so that every other club head is arranged in front of and/or above its neighbours.

An alternative when many clubs are to be fitted in the bag 1 is to arrange the fastening means 31 and the club head separating means 32 at the inside of both the front 10 as well as the back 20 section.

Alternatively, the same thing can be achieved by arranging more than two sections in one and the same bag. In this case, the envelope of the bag is defined by two of the sections, one of which constitutes a front section and one a back section which is foldable out from the front section. There between, one or possibly several sections are arranged, each foldable in relation to the front section along a hinge or a similar arrangement, preferably common to all sections. Thus, in this case, two or possibly several sections may individually comprise an individual fastening system according to the above, so that golf clubs can be fixed along several rows, where each row is arranged at one of the sections. By thereafter first opening the bag, by folding out the back section from the front section, all clubs can easily be accessed by folding the middle section or sections either backwards or forwards in relation to the front section, in a way similar to the turning of pages in a picture book.

To render possible a stable fixing of accommodated golf clubs 2, each section comprising fastening means 31 also comprises a stabilizing device. For example, such a device can be in the form of the section manufactured from a rigid material, such as rigid plastic or metal, and/or of the section for example comprising stabilizing beams.

Moreover, the front section 10 is preferably arranged with a similar stabilizing device, in order to impart sufficient rigidity to the bag 1 when carried as a back pack. According to an especially preferred embodiment, the front section 10 is partly manufactured from vacuum moulded plastic, KEVLAR® or a corresponding material, and also comprises stabilizing channels and/or beams.

The vertical positioning of the clubs 2 in the bag 1, together with the back pack style carrying system 14, allows excellent ergonomics when transporting the golf equipment in the bag 1. It is possible to achieve a sufficiently low centre of gravity, among other things since the heavier club heads 2*b* point downwards. Also, the hip belt 16 allows the shoulders of the user to be relieved. Since the clubs 2 are fixed inside the bag, and since the bag 1 can be fastened to the back of the user using the carrying system 14, the bag 1 may present satisfactory ergonomics even when for example running or walking briskly, without being perceived as jerky or rattly.

It is essential that one may also transport the golf equipment in the bag 1 with satisfactory ergonomics when travelling by bike, on a motorcycle or similar. Namely, the bag 1 does not extend outside of the sides of the user, which reduces the risk of the bag 1 hitting something during transport.

Hence, the bag 1 may be opened by folding apart the two sections 10, 20. According to a preferred embodiment, the bag 1 comprises a locking means 4, arranged to, when in an activated mode, openably retain the bag 1 in its closed position. In other words, the bag 1 is resealably openable. This is best illustrated in FIGS. 1*a* and 1*b*.

The bag 1 according to the FIGS. 1*a*-2*b* comprises support means 40, so that it may stand in a stable manner on a supporting surface when in its opened position, even on sloping ground and in uneven grass.

Figure 1B:
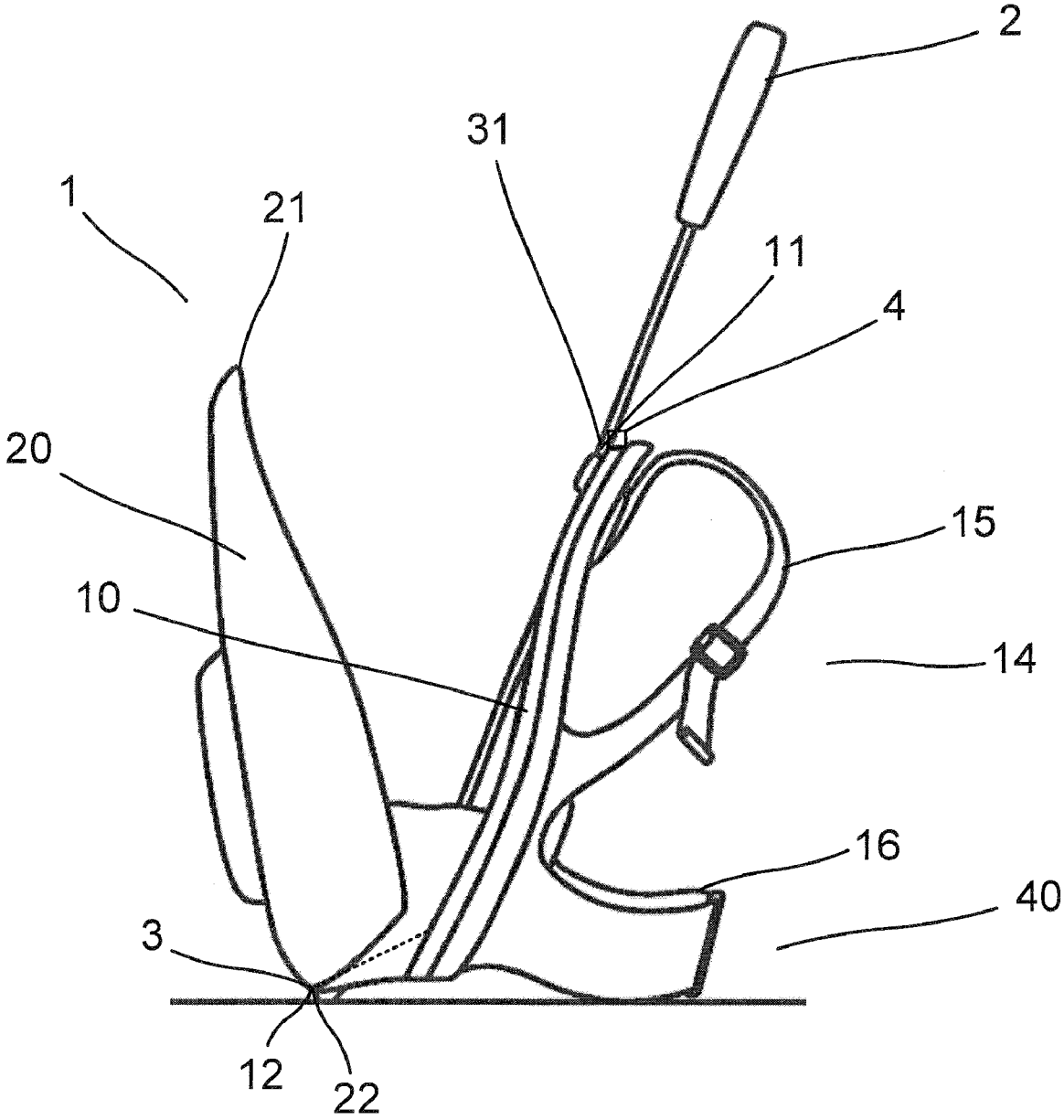
FIG. 1*b* is a perspective view of a bag according to the present invention, in its opened position.
Figure 2A:
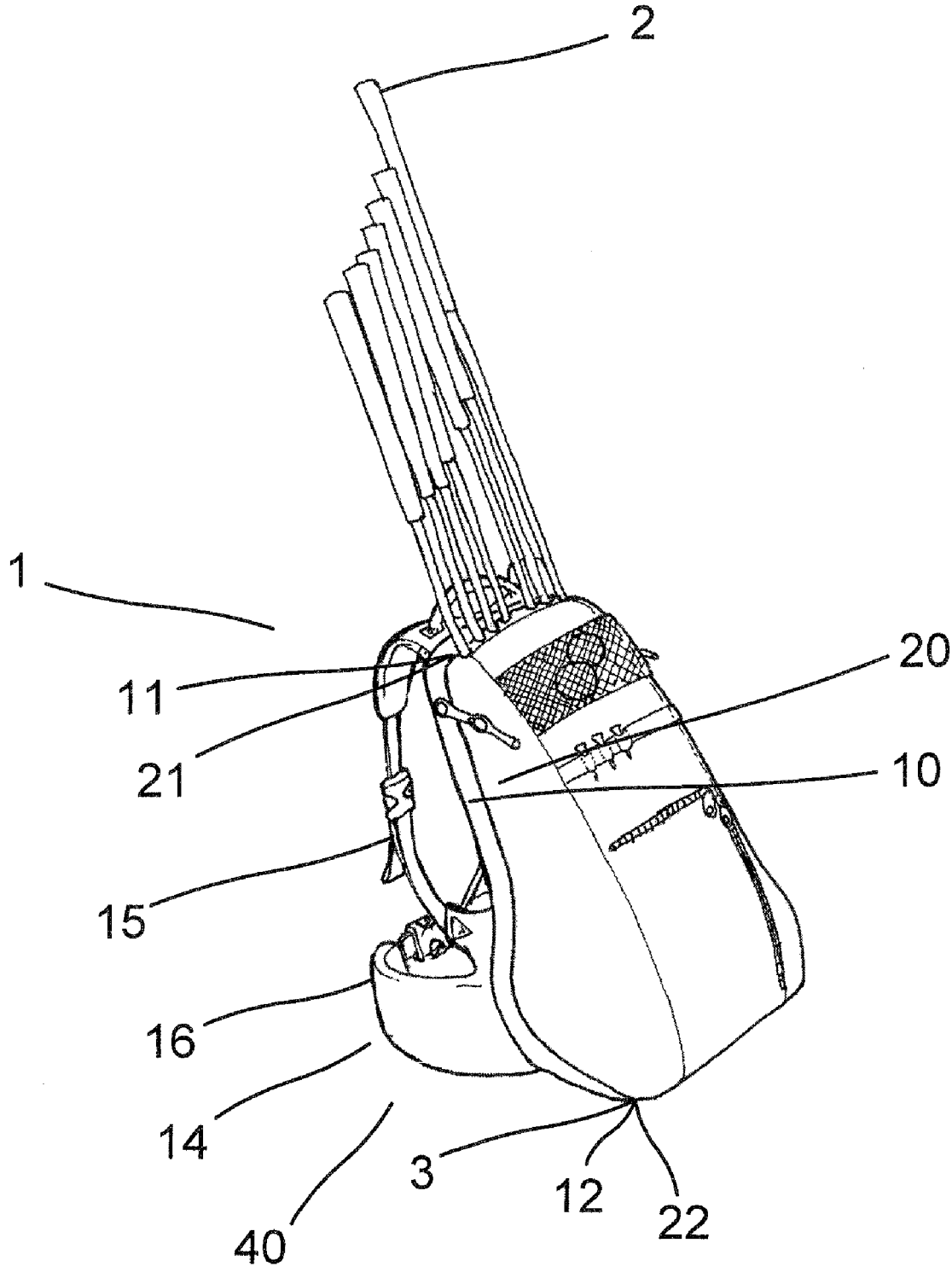
FIG. 2*a* is a side view of a bag according to the present invention, in its closed position.
Figure 2B:
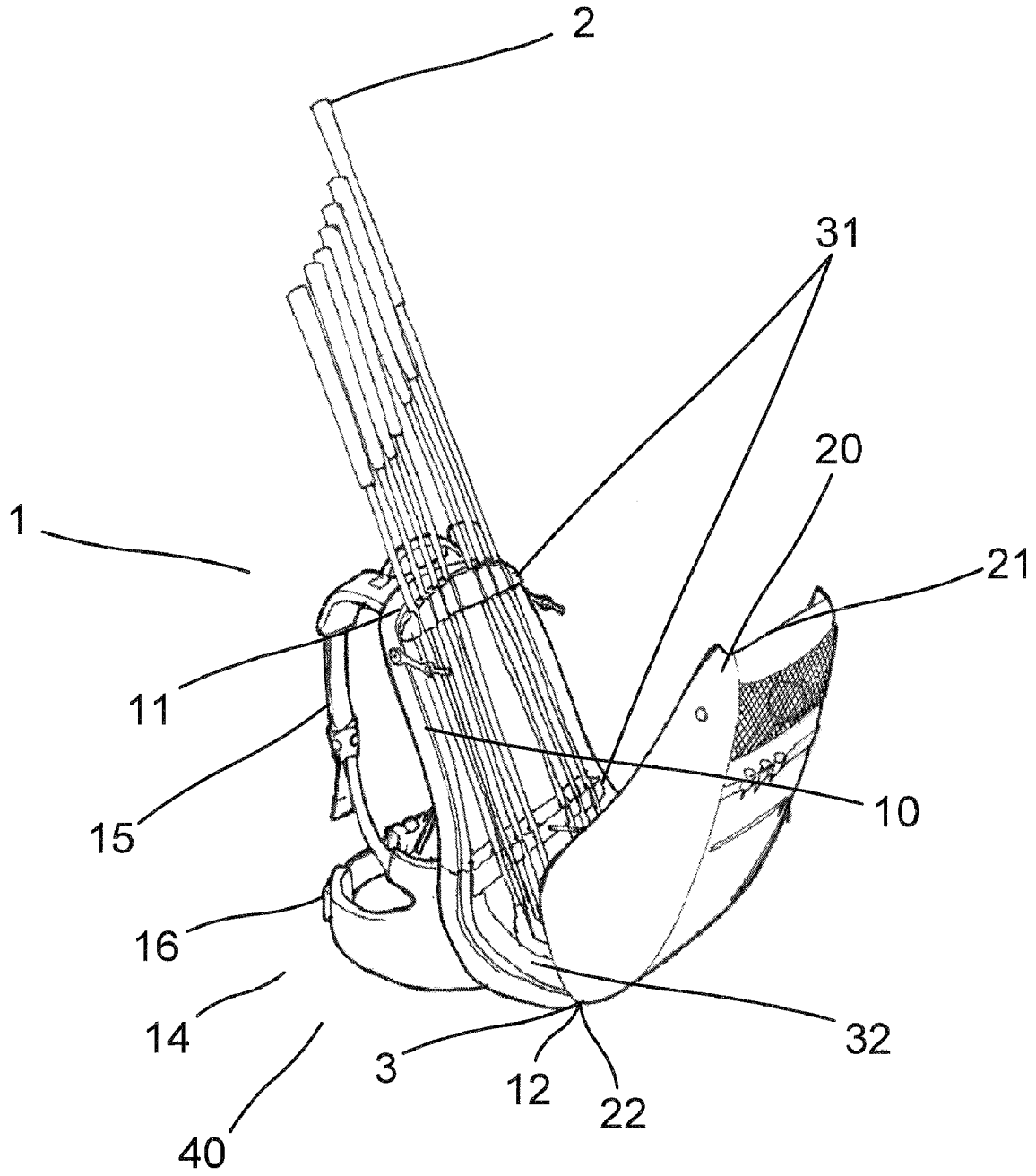
FIG. 2*b* is a side view of a bag according to the present invention, in its opened position.

According to a preferred embodiment, best shown in FIGS. 1*a* and 1*b*, the hip belt 16 comprises two side portions 16*a*, 16*b*, each extending perpendicularly from the bag 1, arranged to circumscribe the body of the user on either side, and each comprising a respective rigid means. The side portions 16*a*, 16*b* together constitute the support means 40. In other words, the side portions 16*a*, 16*b* are arranged to support the bag 1 by their extending out from the bag 1 in two different directions in the horizontal plane, so that the bag 1 may rest on its own bottom and simultaneously upon both of the side portions 16*a*, 16*b*. For example, the rigid means may be a plate extending in the vertical plane, essentially along and integrated with the side portions 16*a*, 16*b*, and sufficiently flexible to be bent around the body of the user with no need to use any major force, and at the same time so rigid so as to give stability to the bag 1 when it stands on the ground.

That the bag 1 can stand up in a stable manner on the ground is essential, since this allows the user to easily put down the bag 1, open it and choose equipment.

Figure 4:
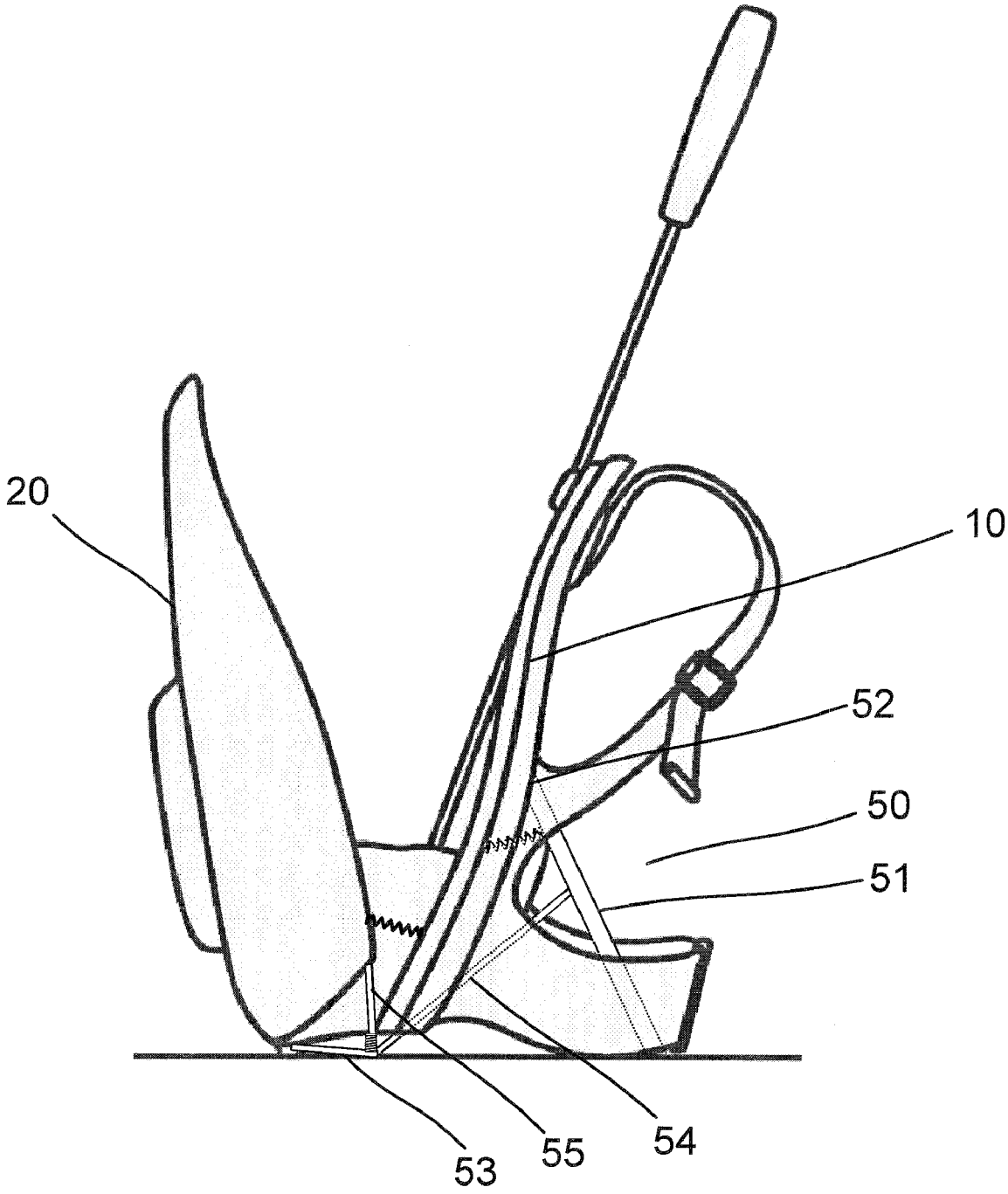
FIG. 4 is a side view of a bag according to the present invention, comprising an explanatory sketch of a link system.

FIG. 4 illustrates a support means 50 according to another embodiment. A foldable support leg 51 is arranged at the exterior side of one of the sections 10, 20, at which section clubs 2 are arranged, in other words at the outer side of the front section 10 in FIG. 4. The support leg 51 is hinged 52 to the exterior side of the section 10 some distance up from the bottom of the bag 1, and can assume a folded in position, essentially in abutment against the exterior side of the section 10, and an folded out position, in which the support leg 51 is arranged to stabilize the bag 1 when the bag 1 is at rest on a supporting surface such as the ground, respectively.

According to a preferred embodiment (not shown), the hinged attachment 52 of the support leg 51 is spring-loaded, using a coil spring or the like, towards its folded out position. A support leg lock at the upper edge of one of the sections is arranged to prevent the support leg 51 from folding out when the support leg lock is activated. The support leg lock is preferably a push button, which is integrated in a handle arranged at the upper edge of the front section 10, and arranged for using when lifting the bag 1. Thus, the push button is easily accessible when the bag 1 is put down by the handle, so that the support leg 51 can be easily folded out in connection to the bag 1 being put down on the ground. Furthermore, in this case a transmission means, in the form of a link system, a wire system, or the like, is arranged to bring the support leg 51 towards its folded in position when both of the outer sections 10, 20 are folded together so as to close the bag 1. Thereby, the support leg 51 is automatically folded in when the bag 1 is closed.

In this case, the hinge 3 can also be spring-loaded, towards the open position of the bag 1. Thus, by inactivating the locking means 4, the bag 1 can be opened automatically. According to a preferred embodiment, the support leg lock and the locking means 4 are one and the same, and consists of the above described lock in the handle of the bag 1.

According to another preferred embodiment, the support leg 51 is spring-loaded in the opposite direction, that is towards its folded in position. In this case, a first push plate 53 is arranged at the bottom side of the bag 1, so that the push plate 53 is pressed inwards towards the bag 1 from below, by the force of gravity of the bag, when the bag 1 is put down on a supporting surface. A second transmission means 54, in the form of a link system, a wire system or the like, is arranged to bring the support leg 51 towards its folded out position when the first push plate 53 is pushed in. Thus, the support leg 51 is automatically folded out when the bag 1 is put down on a supporting surface, such as the ground, so that the bag 1 can stand in a stable manner.

The push plate 53, the transmission means 54, and the support leg 51, as shown in FIG. 4, aim to principally and schematically illustrate the function of these components. Essentially, the function of these parts corresponds to that of conventional golf carry bags, where a support leg is folded out when the carry bag is put down onto the ground.

According to another preferred embodiment, the hinge 3 is spring-loaded towards the closed position of the bag 1. In this case, a second push plate is arranged at the bottom side of the bag 1, so that the second push plate is pushed in towards the bag 1 from below when the bag 1 is put down onto a supporting surface. A third transmission means 55, in the form of a link system, a wire system or the like, and in FIG. 4 shown schematically, is arranged to fold the back section 20 out from the front section 10, and thus to bring the bag 1 towards its opened position, when the second push plate is pushed in.

According to an especially preferred embodiment, illustrated in FIG. 4, the first and the second push plates are one and the same, whose pushing in towards the bottom of the bag 1 thus leads to the bag 1 to being opened and to the support leg 51 being folded out. When the bag 1 is put down onto the ground, this firstly causes the bag 1 to quickly and conveniently assume a stable position, and, secondly, lets the user quickly to gain access to the interior of the bag 1.

According to a preferred embodiment, both the transmission means 54, 55 may be locked using a lock, being one and the same as the locking means 4 and/or the support leg lock described above or resembling any of these.

According to a preferred embodiment, a push plate is connected to the locking means 4 via a link system resembling one of the above described, so as to automatically deactivate the locking means 4 when the bag 1 is put down onto the ground.

According to yet another preferred embodiment, the handle is vertically movable in relation to the bag 1, and constitutes as such the locking means 4 and/or the support leg lock. In other words, the handle is arranged to be pulled out from the bag 1 when the bag 1 is being lifted using the handle, because of the gravitational force of the bag 1, but is spring-loaded so that it is pulled back towards the bag 1, because of the spring force, when the user lets go of the handle in connection with the bag 1 being put down onto a supporting surface. To this end, the handle may be arranged to release a back section 20, which is spring-loaded out from the bag 1, when the handle is brought, by the spring force, down towards the bag 1, so that the bag 1 is opened. Also, the handle may be arranged to, in a corresponding manner, release a support leg 51, which is spring-loaded out from the bag 1, so that the leg is folded out when the bag 1 is put down onto the ground and the user lets go of the handle. Furthermore, the handle may be arranged to bring the back section 20 back in towards the bag 1 and/or to bring the support leg 51 towards its folded in position when the user again lifts the bag 1 by the handle, via a link- or a wire system similar to those described above. Advantageously, such an arrangement may be supplemented with another lock, such as for example a VELCRO® lock, a button or the like, so that the bag 1 is not reopened when the user, by way of example, lets go of the handle in order to put the bag 1 on his back. Such a supplementary lock is also useful together with the rest of the embodiments described herein, for example during transport.

Thus, the present invention achieves a small-size, low-weight bag for golf clubs and peripheral equipment, which is simple and convenient to transport, even on foot, by bike and so on. The bag offers good ergonomics during transport on the golf course, and does not constitute an obstacle, especially not during rapid transport and/or transport in rough terrain. The bag is especially advantageous for play using only a few clubs, and is also suitable for storing golf equipment when not used. Finally, the above-mentioned arrangements for activating support means and opening the bag makes the bag easy to use.

Above, preferred embodiments have been described. However, it is obvious to the person skilled in the art that many alterations may be performed without departing from the idea of the invention. Thus, the invention shall not be limited by the above described embodiments, but may be varied within the scope of the appended claims.

The invention claimed is:

1. A bag (1) for storage and transport of golf equipment, comprising:

at least two sections (10, 20), each section comprising an upper (11, 21) and a lower (12, 22) edge, respectively, the sections (10, 20) being pivotably interconnected by a hinge (3), and the bag (1) being openable by pivoting the sections (10, 20) apart along the hinge (3) from a closed position to an open position in which an interior of the bag (1) is uncovered;

support means (40, 50) for supporting the bag (1) in an a stable manner on a supporting surface when in the open position;

shoulder straps (15) attached to an exterior side of one of the sections (10), the exterior side facing opposite the other of the at least two sections, and each of the shoulder straps extending in a vertical direction from the lower edge to the upper edge of the one of the sections (10); and a hip belt (16) attached to a lower portion of the exterior side of the one of the sections (10), wherein at least one section comprises an upper part and a lower part, the upper part comprising fastening means (31) for one or more golf club shafts (2*a*), and the lower part comprising club head separating means (32) for receiving club heads (2*b*) of the one or more golf clubs (2), wherein the hinge (3) is arranged along the lower respective edge (12, 22) of each of the sections (10, 20), and wherein the one of the sections (10), on the exterior side facing opposite the other of the at least two sections, further comprises a stabilizing arrangement configured to render the bag (1) rigid for being carried as a back pack.

2. The bag (1) according to claim 1, wherein the fastening means (31) are arranged essentially vertically above the club head separating means (32) when the bag (1) is in an upright position to accommodate the one or more golf clubs (2) essentially vertically such that shafts (2*a*) of the one or more golf clubs (2) extend upwards.

3. The bag (1) according to claim 1, wherein both the fastening means (31) and the club head separating means (32) are both provided in one of the at least two sections, and wherein the one of the at least two sections comprises a rigid material to fix the position of the accommodated golf clubs (2) by an engagement with the fastening means (31) and the club head separating means (32).

4. The bag (1) according to claim 3, wherein the bag (1) comprises two sections, each of said two sections comprising both fastening means and club head separating means.

5. The bag (1) according to claim 3, wherein the bag (1) comprises three sections, wherein two of the three sections arranged furthest away from each other each are pivotably interconnected to a third of the three sections arranged between the two of the three sections, and wherein an envelope of the bag (1) is essentially defined by the two of the three sections arranged furthest away from each other.

6. The bag (1) according to claim 1, wherein the support means (50) comprises a foldable support leg (51) provided at a side of the one of the sections (10) facing outwards from the bag (1), the support leg (51) configured to assume i) a folded-in position abutting the exterior side of the one of the sections (10), and ii) a folded-out position in which the support leg (51) is configured to stabilize the bag (1) when the bag (1) rests on the supporting surface.

7. The bag (1) according to claim 6, wherein the support leg (51) is spring-loaded towards the folded-out position, wherein a support leg lock is arranged at the upper edge of either of a first of the sections (10, 20) or a second of the sections (10, 20) and configured to stop the support leg (51) from being folded out when the support leg lock is activated, and wherein a first transmission means is arranged to bring the support leg (51) towards the folded-in position upon the sections (10, 20) being folded together to the closed position.

8. The bag (1) according to claim 6, wherein the support leg (51) is spring-loaded towards the folded-in position, wherein a first push plate (53) is provided at a bottom side of the bag (1) the first push plate (53) urged in towards the bag (1) when the bag (1) is placed on the supporting surface, and wherein a second transmission means (54) is arranged to bring the support leg (51) towards the folded-out positions upon the first push plate (53) is being pushed in.

9. The bag (1) according to claim 1, wherein the hip belt (16) comprises two side portions (16*a*, 16*b*) extending vertically from the bag (1) and configured to circumscribe either side of a user's body, wherein both of the two side portions (16*a*, 16*b*) comprise a rigid means, and wherein in that the two side portions (16*a*, 16*b*) together constitute the support means (40).

10. The bag (1) according to claim 1, wherein the hinge (3) is spring-loaded towards the opened position of the bag (1), and wherein a locking means (4) is arranged at the upper edge (11) of the one of the sections (10) configured such that when the locking means (4) is activated the bag (1) is prevented from being opened from the closed position.

11. The bag (1) according to claim 1, wherein the hinge (3) is spring-loaded towards the closed position, a second push plate (53) being provided at a bottom side of the bag (1) such that the second push plate (53) is pushed in towards the bag (1) from below upon the bag (1) being put down onto the supporting surface, and wherein a third transmission means (55) is provided to fold a first (20) of the sections out from a second (10) of the sections towards the open position upon the second push plate (53) being pushed in towards the bag (1).

12. The bag (1) according to claim 2, wherein both the fastening means (31) and the club head separating means (32) are both provided in one of the at least two sections, and wherein the one of the at least two sections comprises a rigid material to fix the position of the accommodated golf clubs (2) by an engagement with the fastening means (31) and the club head separating means (32).

13. The bag (1) according to claim 4, wherein the bag (1) comprises three sections, wherein two of the three sections arranged furthest away from each other each are pivotably interconnected to a third of the three sections arranged between the two of the three sections, and wherein an envelope of the bag (1) is essentially defined by the two of the three sections arranged furthest away from each other.

14. A bag (1) for storage and transport of golf equipment, comprising:

at least two sections (10, 20), each section comprising an upper (11, 21) and a lower (12, 22) edge, respectively, the sections (10, 20) being pivotably interconnected by a hinge (3), and the bag (1) being openable by pivoting the sections (10, 20) apart along the hinge (3) from a closed position to an open position in which an interior of the bag (1) is uncovered; and support means (40, 50) for supporting the bag (1) in an a stable manner on a supporting surface when in the open position, comprising a foldable support leg (51) provided at a side of one of the sections (10) facing outwards from the bag (1), the support leg (51) configured to assume i) a folded-in position abutting an exterior side the one of the sections (10), and ii) a folded-out position in which the support leg (51) is configured to stabilize the bag (1) when the bag (1) rests on the supporting surface, wherein the support leg (51) is spring-loaded towards the folded-in position, wherein a first push plate (53) is provided at a bottom side of the bag (1) the first push plate (53) urged in towards the bag (1) when the bag (1) is placed on the supporting surface, and wherein a second transmission means (54) is arranged to bring the support leg (51) towards the folded-out position upon the first push plate (53) being pushed in, wherein at least one section comprises an upper part and a lower part, the upper part comprising fastening means (31) for one or more golf club shafts (2*a*), and the lower part comprising club head separating means (32) for receiving club heads (2*b*) of the one or more golf clubs (2), and wherein the hinge (3) is arranged along the lower respective edge (12, 22) of each section (10, 20).

15. A bag (1) for storage and transport of golf equipment, comprising:

at least two sections (10, 20), each section comprising an upper (11, 21) and a lower (12, 22) edge, respectively, the sections (10, 20) being pivotably interconnected by a hinge (3), and the bag (1) being openable by pivoting the sections (10, 20) apart along the hinge (3) from a closed position to an open position in which an interior of the bag (1) is uncovered; and support means (40, 50) for supporting the bag (1) in an a stable manner on a supporting surface when in the open position, wherein at least one section comprises an upper part and a lower part, the upper part comprising fastening means (31) for one or more golf club shafts (2*a*), and the lower part comprising club head separating means (32) for receiving club heads (2*b*) of the one or more golf clubs (2), wherein the hinge (3) is arranged along the lower respective edge (12, 22) of each section (10, 20), wherein the hinge (3) is spring-loaded towards the closed position, a second push plate (53) being provided at a bottom side of the bag (1) such that the second push plate (53) is pushed in towards the bag (1) from below upon the bag (1) being put down onto the supporting surface, and wherein a third transmission means (55) is provided to fold a first (20) of the sections out from a second (10) of the sections towards the open position upon the second push plate (53) being pushed in towards the bag (1).

16. The bag (1) according to claim 14, wherein the fastening means (31) are arranged essentially vertically above the club head separating means (32) when the bag (1) is in an upright position to accommodate the one or more golf clubs (2) essentially vertically such that shafts (2*a*) of the one or more golf clubs (2) extend upwards.

17. The bag (1) according to claim 15, wherein the fastening means (31) are arranged essentially vertically above the club head separating means (32) when the bag (1) is in an upright position to accommodate the one or more golf clubs (2) essentially vertically such that shafts (2*a*) of the one or more golf clubs (2) extend upwards.

18. The bag (1) according to claim 14, wherein the support means (50) comprises a foldable support leg (51) provided at a side of the one of the sections (10) facing outwards from the bag (1), the support leg (51) configured to assume i) a folded-in position abutting the exterior side of the one of the sections (10), and ii) a folded-out position in which the support leg (51) is configured to stabilize the bag (1) when the bag (1) rests on the supporting surface.

19. The bag (1) according to claim 15, wherein the support means (50) comprises a foldable support leg (51) provided at a side of the one of the sections (10) facing outwards from the bag (1), the support leg (51) configured to assume i) a folded-in position abutting the exterior side of the one of the sections (10), and ii) a folded-out position in which the support leg (51) is configured to stabilize the bag (1) when the bag (1) rests on the supporting surface.

* * * * *